US006655646B2

(12) United States Patent
Johnson

(10) Patent No.: US 6,655,646 B2
(45) Date of Patent: Dec. 2, 2003

(54) KEYBOARD SUPPORT APPARATUS

(75) Inventor: Bobbi J. Johnson, Dakota City, NE (US)

(73) Assignee: Gateway, Inc., Poway, CA (US)

( * ) Notice: Subject to any disclaimer, the term of this patent is extended or adjusted under 35 U.S.C. 154(b) by 0 days.

(21) Appl. No.: 09/752,663

(22) Filed: Dec. 28, 2000

(65) Prior Publication Data

US 2002/0084395 A1 Jul. 4, 2002

(51) Int. Cl.[7] ..... E04G 3/00; A47B 3/00

(52) U.S. Cl. ..... 248/285.1; 248/276.1; 248/279.1; 248/286.1; 248/918; 108/39; 108/40

(58) Field of Search ..... 248/285.1, 286.1, 248/918, 276.1, 279.1, 318, 326, 333, 917, 447; 108/42, 39, 40, 5, 6, 7, 9, 143, 149, 147.2; 312/247, 248, 325

(56) References Cited

U.S. PATENT DOCUMENTS

| | | | | | |
|---|---|---|---|---|---|
| 883,305 | A | * | 3/1908 | Fetch | 312/27 |
| 1,888,257 | A | * | 11/1932 | Bennett | 248/447 |
| 3,383,082 | A | * | 5/1968 | Larson | 248/495 |
| 4,460,145 | A | * | 7/1984 | Ando | 108/140 |
| 4,483,572 | A | * | 11/1984 | Story | 248/918 |
| 4,625,657 | A | * | 12/1986 | Little et al. | 108/138 |
| 4,644,875 | A | | 2/1987 | Watt | |
| 4,691,888 | A | * | 9/1987 | Cotterill | 108/1 |
| 4,718,740 | A | * | 1/1988 | Cox | 312/223.2 |
| 4,776,284 | A | * | 10/1988 | McIntosh | 108/138 |
| 4,843,978 | A | | 7/1989 | Schmidt et al. | |
| 4,862,764 | A | * | 9/1989 | Gehring | 74/606 R |
| 4,941,718 | A | * | 7/1990 | Alexander et al. | 312/312 |
| 5,041,770 | A | * | 8/1991 | Seiler et al. | 318/265 |
| 5,176,351 | A | * | 1/1993 | Moore | 248/286.1 |
| 5,211,367 | A | | 5/1993 | Musculus | |
| 5,230,289 | A | | 7/1993 | George | |
| 5,257,767 | A | | 11/1993 | McConnell | |
| 5,273,250 | A | * | 12/1993 | Pemberton et al. | 108/5 |
| 5,302,015 | A | | 4/1994 | Du Val | |
| 5,329,865 | A | * | 7/1994 | McWard | 109/50 |
| 5,390,764 | A | * | 2/1995 | Kerber | 186/68 |
| 5,393,029 | A | * | 2/1995 | Senko | 248/447 |
| 5,535,852 | A | * | 7/1996 | Bishop et al. | 187/336 |
| 5,646,819 | A | | 7/1997 | Hill, III | |
| 5,673,169 | A | | 9/1997 | Wicks | |
| 5,683,064 | A | | 11/1997 | Copeland et al. | |
| 5,758,934 | A | * | 6/1998 | Flutka et al. | 108/50.01 |
| 5,878,674 | A | | 3/1999 | Allan | |
| 5,924,664 | A | | 7/1999 | Mileos et al. | |
| 6,124,902 | A | * | 9/2000 | Rosen | 348/837 |
| 6,176,456 | B1 | * | 1/2001 | Wisniewski | 248/281.11 |
| 6,186,459 | B1 | * | 2/2001 | Ma | 248/276.1 |
| 6,208,505 | B1 | | 3/2001 | Kuchta et al. | |
| 6,256,078 | B1 | * | 7/2001 | Ogata | 349/58 |
| 6,262,885 | B1 | | 7/2001 | Emma et al. | |
| 6,316,847 | B1 | * | 11/2001 | Crockett | 248/326 |
| 6,325,342 | B1 | * | 12/2001 | Dignat | 248/118 |
| 6,416,027 | B1 | * | 7/2002 | Hart | 248/324 |

* cited by examiner

*Primary Examiner*—Leslie A. Braun
*Assistant Examiner*—Amy J. Sterling
(74) *Attorney, Agent, or Firm*—Scott Charles Richardson; Kevin E. West; Suiter-West PC LLO

(57) ABSTRACT

A keyboard support apparatus comprises a storage compartment adapted to be mounted to the undersurface of an overhead cabinet, a low ceiling, and the like. The keyboard support apparatus further comprises at least one extendable support arm pivotally coupled at one end to the storage compartment, and a keyboard platform pivotally coupled at opposite sides to the other end of the support arms. Each support arm is adapted to extend downwardly from the storage compartment to position the keyboard platform below the storage compartment in an operational configuration. Each support arm is also adapted to contract upwardly to position the keyboard platform inside the storage compartment in a storage configuration.

26 Claims, 11 Drawing Sheets

KEYBOARD SUPPORT APPARATUS

FIELD OF THE INVENTION

The present invention relates to keyboard support apparatuses, and more specifically, to a keyboard support apparatus adapted to be mounted to an undersurface of an overhead cabinet, an overhead shelf, a low ceiling, and the like.

BACKGROUND OF THE INVENTION

Many keyboard support apparatuses are typically mounted to an undersurface of a desktop inside a space provided under the desktop for accommodating a person's legs. These keyboard support apparatuses usually comprise a keyboard platform that can slide underneath the desktop for supporting a keyboard. The keyboard platform can be pulled out from under the desktop to position the keyboard at a front edge of the desktop when the keyboard is in use. The keyboard platform can also be pushed in under the desktop to conveniently store the keyboard under the desktop when the keyboard is not in use.

A drawback of these keyboard support apparatuses is that they typically support a keyboard at a height that is level with or slightly below the desktop. As a result, food or drinks that are placed on top of the desktop may spill onto the keyboard, which may damage the keyboard. Another drawback is that countertops in many kitchens and laboratories do not have an undersurface available for mounting these keyboard support apparatuses because such countertops are typically built on top of cabinets or drawers. As a result, a person may not be able to use these keyboard support apparatuses to support a keyboard when working from a countertop in a kitchen or a laboratory.

Therefore, there is a need for a keyboard support apparatus that supports a keyboard above a desktop or a countertop, which would prevent food or drinks that are spilled onto the desktop or the countertop from damaging a keyboard. In addition, there is a need for a keyboard support apparatus that is adapted to be mounted to an undersurface of an overhead cabinet, an overhead shelf, a low ceiling, and the like. This would allow a person to use the keyboard support apparatus to support a keyboard when working from a countertop that does not have an undersurface available for mounting a keyboard support apparatus.

SUMMARY OF THE INVENTION

Embodiments of the present invention provide a keyboard support apparatus that is adapted to be mounted to an undersurface of an overhead cabinet, an overhead shelf, a low ceiling, and the like.

In a preferred embodiment of the invention, the keyboard support apparatus comprises a storage compartment adapted to be mounted to the undersurface of an overhead cabinet, an overhead shelf, a low ceiling, and the like. The keyboard support apparatus further comprises at least one extendable support arm pivotally coupled at one end to the storage compartment, and a keyboard platform pivotally coupled to the other end of the at least one support arm. Each support arm is adapted to extend downwardly from the storage compartment to position the keyboard platform below the storage compartment in an operational configuration. Each support arm is also adapted to contract upwardly to position the keyboard platform inside the storage compartment in a storage configuration.

Other aspects and advantages of the invention will become apparent upon reading the following detailed description of the preferred embodiments and upon reference to the accompanying drawings.

BRIEF DESCRIPTION OF THE DRAWINGS

The numerous aspects and advantages of the present invention will become apparent upon reading the following detailed description of the preferred embodiments and upon reference to the accompanying drawings in which.

DETAILED DESCRIPTION OF THE PREFERRED EMBODIMENTS

Embodiments of the present invention provide a keyboard support apparatus that is adapted to be mounted to an undersurface of an overhead cabinet, an overhead shelf, a low ceiling, and the like.

Figure 1A:
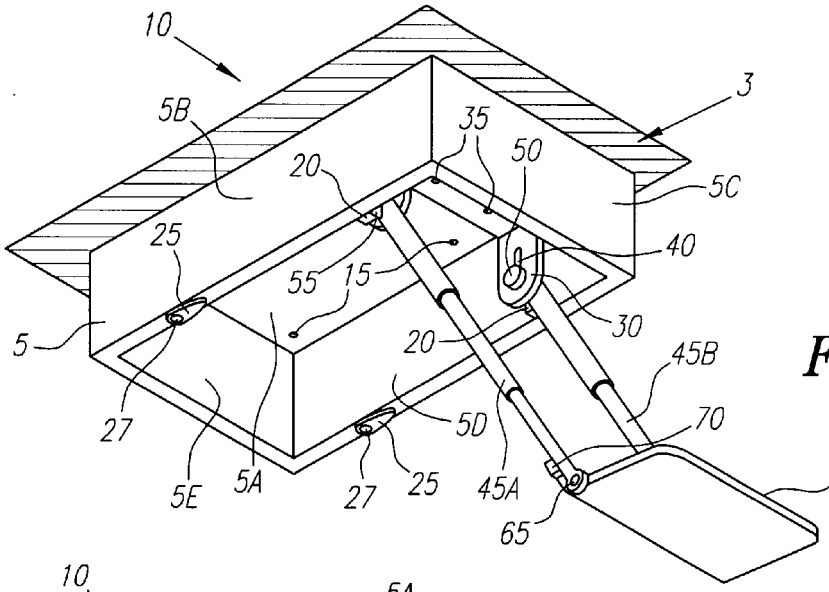
FIG. 1A shows a perspective view of a keyboard support apparatus in an operational configuration according to one embodiment of the invention.
Figure 1B:
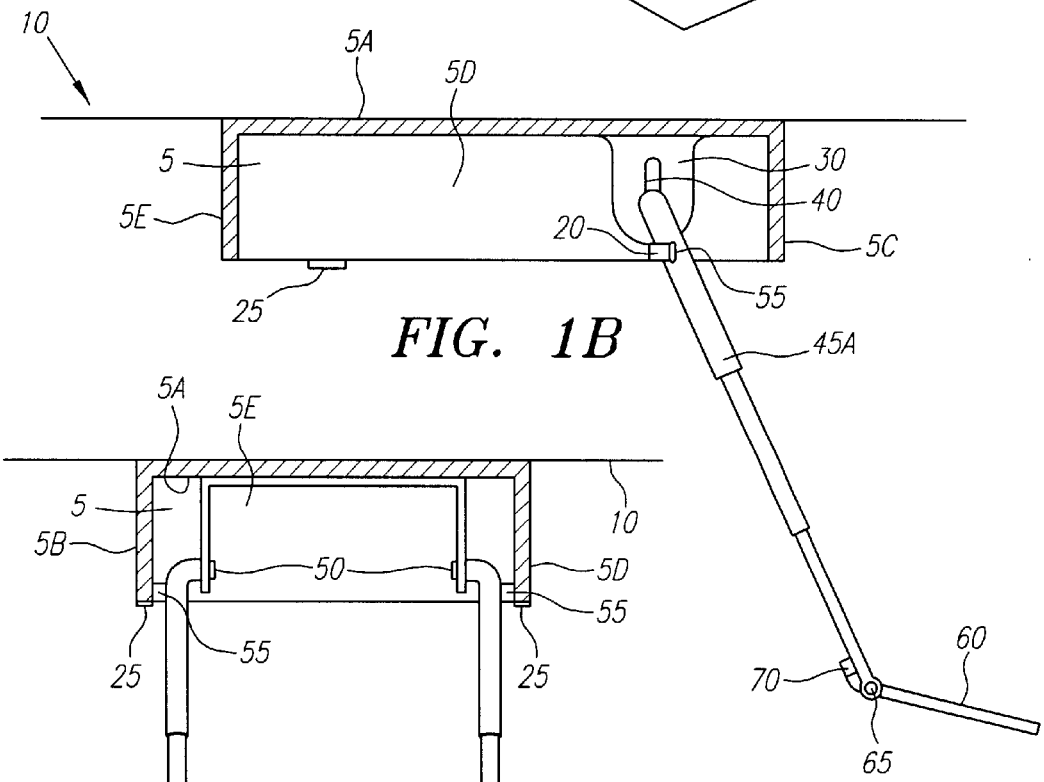
FIG. 1B shows a side view of the keyboard support apparatus illustrated in FIG. 1A, in which side 5B of the storage compartment has been cutaway.
Figure 1C:
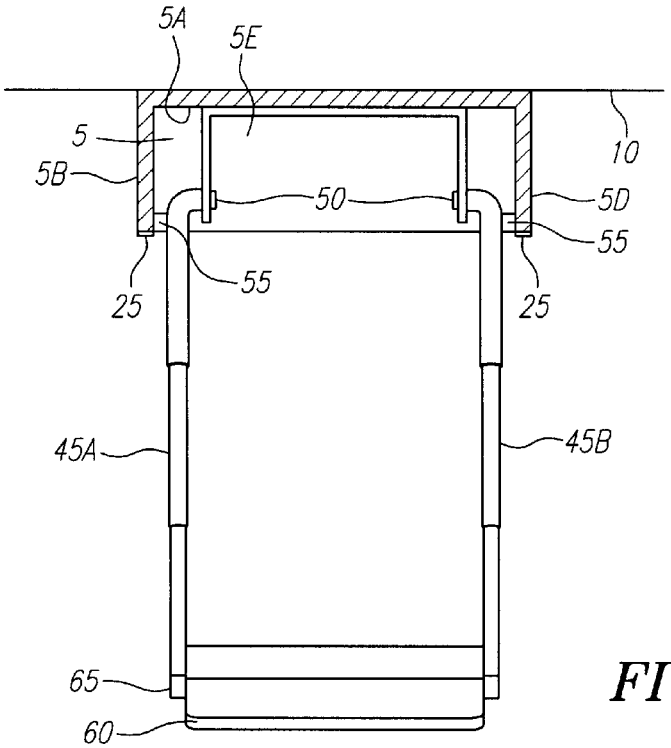
FIG. 1C shows a front view of the keyboard support apparatus illustrated in FIG. 1C, in which side 5C of the storage compartment has been cutaway.

FIG. 1A shows a perspective view of a keyboard support apparatus 3 in an operational configuration according to one embodiment of the present invention. The keyboard support apparatus 3 comprises a storage compartment 5 or housing preferably having a top 5A, four sides 5B–5E and an open bottom. For ease of illustration, FIG. 1B shows a side view of the keyboard support apparatus 3 in which side 5B of the storage compartment 5 has been cutaway. FIG. 1C shows a front view of the keyboard support assembly 3 in which side 5C of the storage compartment 5 has been cutaway. In alternative embodiments, the top 5A may be omitted. In further alternative embodiments, three of the four sides 5B–5E, as well as any other components attached, connected, or otherwise coupled to the sides 5B–5E, may also be omitted.

Referring to FIGS. 1A–1C, the top 5A of the storage compartment 5 is adapted to be mounted to an undersurface of an overhead cabinet 10, an overhead shelf, a low ceiling, and the like. The storage compartment 5 may be mounted to the overhead cabinet 10 by screws 15 threaded into the cabinet 10 through holes in the top 5A of the storage compartment 5. The storage compartment 5 may be made of various materials including, but not limited to, plastic, metal, and wood. To better match the overhead cabinet 10, the storage compartment 5 may be made of the same material as the cabinet 10.

The storage compartment 5 further comprises two tabs 20 attached to opposite inner sides 5B and 5D of the storage compartment and extending inwardly. The storage compartment 5 also comprises latches 25 pivotally connected to the bottom of opposite sides 5B and 5D of the storage compartment 5. The latches 25 may be pivotally connected to the storage compartment 5 by pivot pins 27 inserted into the storage compartment 5 through holes in the latches 25. The latches 25 may be rotated from a position substantially parallel to sides 5B and 5D of the storage compartment 5, as shown in FIG. 1A, to a position perpendicular to sides 5B and 5D of the storage compartment 5.

The keyboard support apparatus 3 also comprises a bracket 30, preferably made of metal, and having two bent sides on opposite ends of the bracket 30. Each bent side of the bracket 30 has an elongated slot 40. The bracket 30 is mounted to the top 5A of the storage compartment 5 by screws 35 threaded into the storage compartment 5 through holes in the bracket 30. In alternative embodiments, the bracket 30 may be mounted directly to the overhead cabinet 10 by screws 35 threaded into the cabinet 10 through holes in the bracket 30.

In preferred embodiments, the keyboard support apparatus 3 further comprises two telescoping arms 45A and 45B. However, in other embodiments, the keyboard support apparatus 3 may include only one telescoping arm 45A or 45B, or alternatively, more than two telescoping arms 45A and 45B. Each telescoping arm 45A and 45B preferably comprises a plurality of arms that can slide into one another for extending or contracting the telescoping arm 45A and 45B. The telescoping arms 45A and 45B are shown fully extended in FIGS. 1A–1C. Each telescoping arm 45A and 45B is pivotally and slideably connected to one of the bent sides of the bracket 30 by a pivot pin 50 inserted into the telescoping arm 45A and 45B through the respective elongated slot 40. The pivot pin 50 may be inserted into the respective telescoping arm 45A and 45B by threading the pivot pin 50 into the telescoping arm 45A and 45B or by tightly pressing the pivot pin 50 into a hole in the telescoping arm 45A and 45B. Each pivot pin 50 can rotate and slide up and down in the respective elongated slop 40. This enables the telescoping arms 45A and 45B to rotate and move up and down with respect to the bracket 30. In FIGS. 1A–1C, the pivot pins 50 are positioned at the bottom of the elongated slots 40.

Each telescoping arm 45A and 45B further comprises a flange 55 extending outwardly from a side of the telescoping arm 45A and 45B. The flanges 55 are positioned along the telescoping arms 45A and 45B to engage the tabs 20 attached to the sides 5B and 5D of the storage compartment 5 when the pivot pins 50 are positioned at the bottom of the elongated slots 40. This engagement holds the telescoping arms 45A and 45B at a predetermined arm angle with respect to the storage compartment 5 by counter balancing gravitational forces that tend to rotate the telescoping arms 45A and 45B clockwise.

Figure 10:
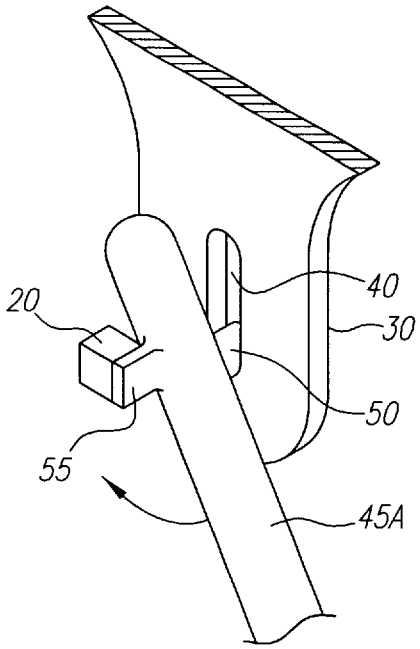
FIG. 10 shows an exploded perspective view of a flange on a telescoping arm according to one embodiment of the invention.

FIG. 10 shows an exploded perspective view, in which side 5B of the storage compartment has been cutaway, of the flange 55 on telescoping arm 45A. The flange 55 extends or protrudes out from the side of telescoping arm 45A. The flange 55 engages or rests against the tab 20 attached to side 5B of the storage compartment 5. This prevents telescoping arm 45A from rotating any further in the clockwise direction, which is indicated by the arrow in FIG. 10.

The keyboard support apparatus 3 further comprises a keyboard platform 60 for supporting a keyboard (not shown). The keyboard may be secured to the keyboard platform 60 by flanges (not shown) on the keyboard platform 60, Velcro, or any other technique well known in the art for securing a keyboard to a keyboard platform. The keyboard platform 60 is pivotally connected at opposite ends to the telescoping arms 45A and 45B by pivot pins 65 inserted into the keyboard platform 60 through holes in the telescoping arms 45A and 45B. Preferably, the telescoping arms 45A and 45B can extend downwardly to a position at which the keyboard platform 60 is about a foot or more below the bottom of the storage compartment 5.

The keyboard platform 60 also comprises two flanges 70 extending outwardly on opposite sides of the keyboard platform 60. Each flange 70 engages a backside of one of the telescoping arms 45A and 45B. This engagement holds the keyboard platform 60 at a predetermined tilt angle with respect to the telescoping arms 45A and 45B by counter balancing gravitational forces that tend to rotate the keyboard platform 60 clockwise.

Figure 11A:
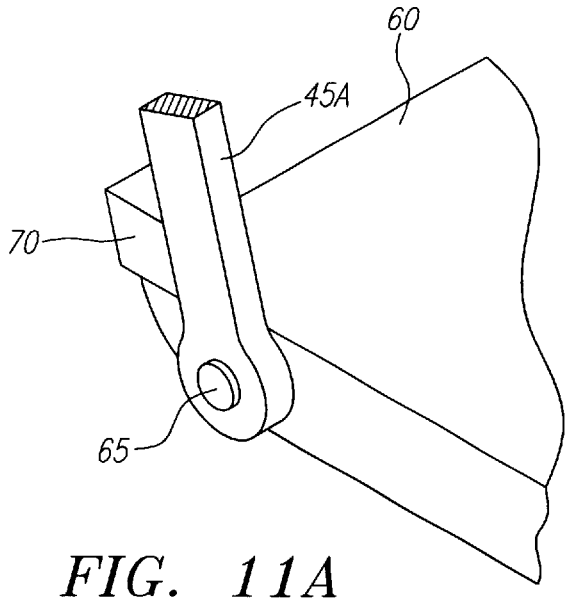
FIG. 11A shows an exploded perspective view of a flange on a keyboard platform according to one embodiment of the invention.
Figure 11B:
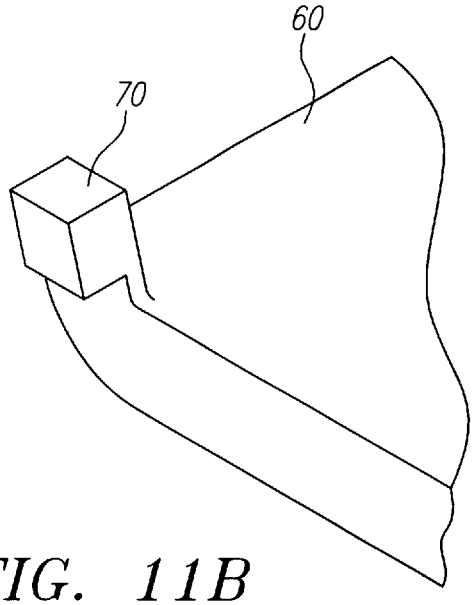
FIG. 11B shows the same view as FIG. 11A in which the telescoping arm in FIG. 11A has been removed.

FIG. 11A shows an exploded perspective view of one of the flanges 70 on the keyboard platform 60. FIG. 11B shows the same view as FIG. 11A in which the telescoping arm 45A has been removed. The flange 70 extends or protrudes out from the side of the keyboard platform 60. The flange 70 engages or pushes against the backside of telescoping arm 45A to hold the keyboard platform 60 at the predetermined tilt angle. This prevents the keyboard platform 60 from rotating any further in the clockwise direction.

The slope of the flange 70 surfaces engaging the backside of the telescoping arms 45A and 45B determines the tilt angle of the keyboard platform 60. Therefore, the tilt angle of the keyboard platform 60 may be made adjustable by making the slope of the flange 70 surfaces adjustable with respect to the keyboard platform 60. This may be accomplished, for example, by making the flanges 70 out of separate pieces and attaching them to opposite sides of the keyboard platform 60 using screws (not shown). The slope of the flange 70 surfaces may be adjusted by loosening the screws. The flange 70 surfaces may then be locked at a slope corresponding to a desired tilt angle by tightening the screws.

FIGS. 1A–1C show the keyboard support apparatus 3 in an operational configuration in which a person is using a keyboard (not shown) supported on the keyboard platform 60. The keyboard support apparatus 3 can also be configured into a storage configuration for compactly storing the keyboard inside the storage compartment 5 when it is not in use.

Figure 1D:
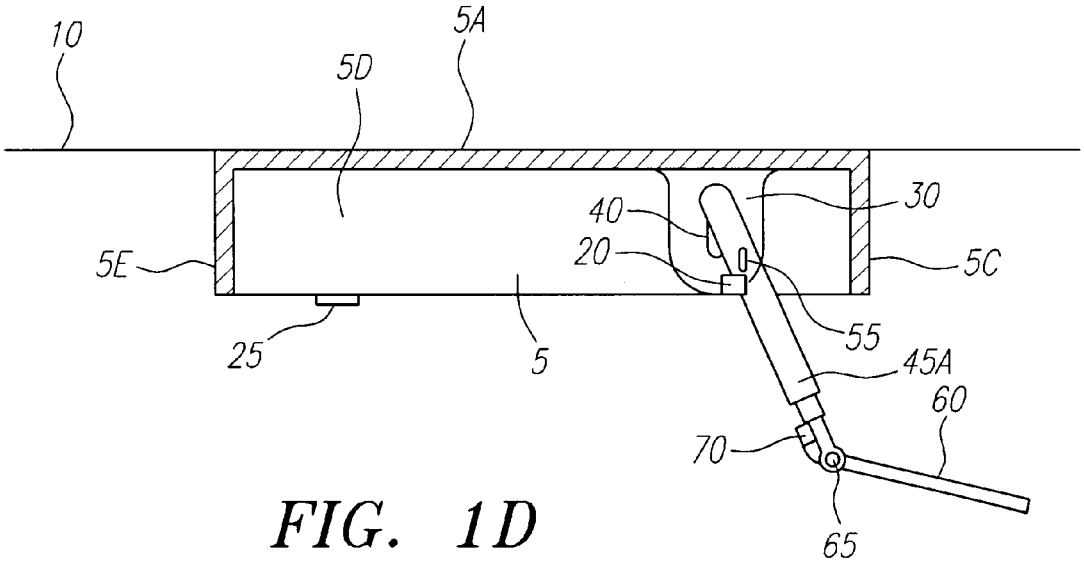
FIG. 1D shows a side view of the keyboard support apparatus, in which side 5B of the storage compartment has been cutaway, in an intermediate configuration according to one embodiment of the invention.
Figure 1E:
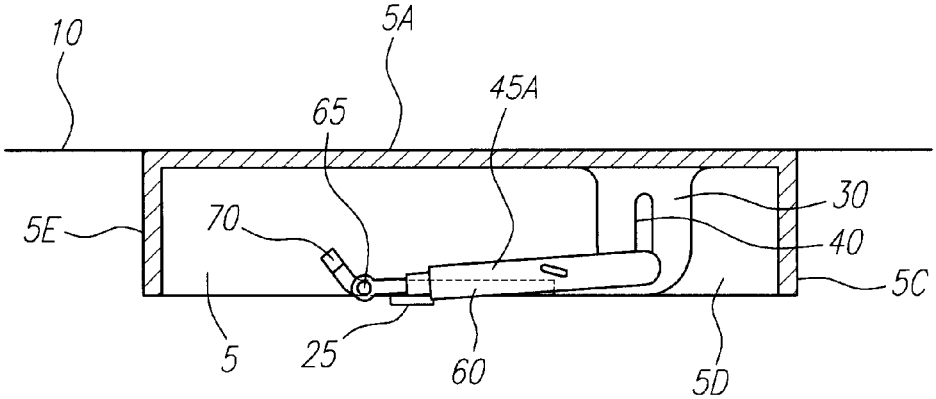
FIG. 1E shows a side view of the keyboard support apparatus, in which side 5B of the storage compartment has been cutaway, in a storage configuration according to one embodiment of the invention.

The steps for configuring the keyboard support apparatus 3 into the storage configuration will now be described with reference to FIGS. 1D and 1E. FIGS. 1D and 1E show a side view of the keyboard support apparatus 3, in which side 5B of the storage compartment 5 has been cutaway.

FIG. 1D shows an intermediate configuration in which the telescoping arms 45A and 45B are contracted to their minimum length. This may be done by pushing the keyboard platform 60 up from its position in the operational configuration. In addition, the pivot pins 50 pivotally connecting the telescoping arms 45A and 45B to the bracket 30 are raised up from their position in the operational configuration. This raises the flanges 55 of the telescoping arms 45A and 45B above the tabs 20 attached to the sides 5A and 5B of the storage compartment 5, which disengages the flanges 55 from the tabs 20, and allows the telescoping arms 45A and 45B to be rotated clockwise.

Figure 12:
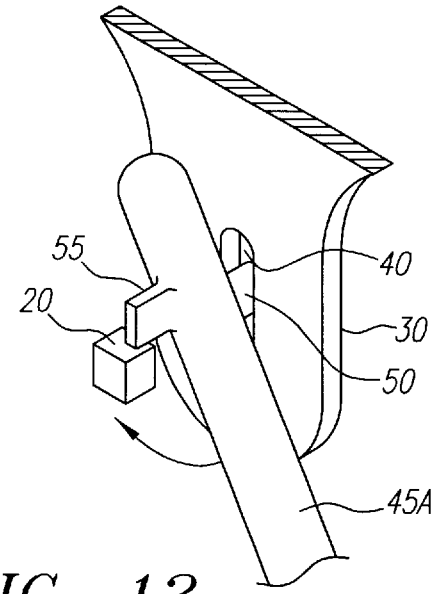
FIG. 12 shows an exploded perspective view of the flange of the telescoping arm when the keyboard support apparatus is in the configuration shown in FIG. 1D according to one embodiment of the invention.

FIG. 12 shows an exploded perspective view of telescoping arm 45A in the configuration shown in FIG. 1D. In FIG. 12, telescoping arm 45A is raised up relative to its position in FIGS. 1A–1C by sliding the telescoping arm's 45A pivot pin 50 up the elongated slot 40 in the bracket 30. This raises the flange 55 of telescoping arm 45A above the tab 20 attached to side 5B of the storage compartment 5. As a result, the flange 55 disengages or no longer rests on the tab 20. This allows the telescoping arm 45A to be rotated in the clockwise direction, which is indicated by the arrow in FIG. 12.

FIG. 1E shows the keyboard support apparatus 3 in the storage configuration. The telescoping arms 45A and 45B are positioned inside the storage compartment 5 by rotating the telescoping arms 45A and 45B clockwise from their position in the intermediate configuration. In addition, the keyboard platform 60 is positioned inside the storage compartment 5 by rotating the keyboard counter-clockwise with respect to the telescoping arms 45A and 45B. The latches 25 are rotated to a position perpendicular to the sides 5B and 5D of the storage compartment 5 to support the bottom of the keyboard platform 60 in the storage configuration.

The keyboard support apparatus 3 may be configured back to the operational configuration. In this case, the latches 25 are rotated to a position parallel to the sides 5B and 5D of the storage compartment 5 to release the keyboard platform 60 from the storage compartment 5. The telescoping arms 45A and 45B are then rotated counterclockwise to the position shown in FIG. 1D. As the telescoping arms 45A and 45B are rotated counter-clockwise, the pivot pins 50 pivotally connecting the telescoping arms 45A and 45B to the bracket 30 are raised up so that the flanges 55 can clear the tabs 20. When the flanges 55 are rotated past the tabs 20, the pivot pins 50 are lowered so that the flanges 55 and 55 can engage the tabs 20 to hold the telescoping arms 45A and 45B at a predetermined angle. The telescoping arms 45A and 45B are then fully extended and the keyboard platform 60 is rotated clockwise to its operational position.

Figure 2A:
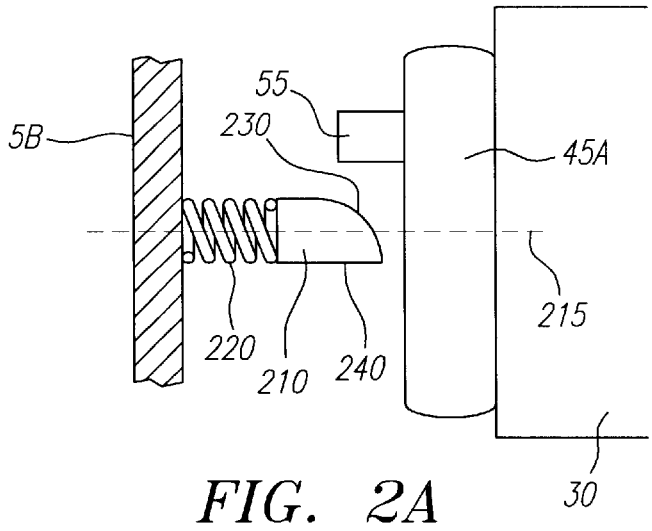
FIGS. 2A–2C show a top view of a spring-biased tab, in which a top of the storage compartment has been cutaway, according to another embodiment of the invention.
Figure 2B:
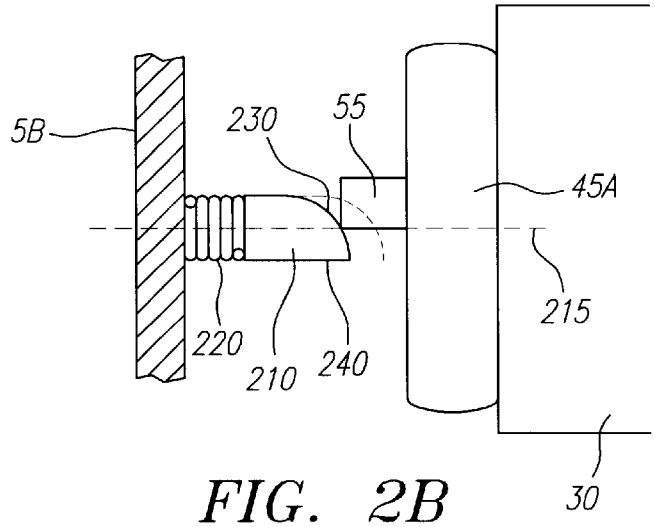
Figure 2C:
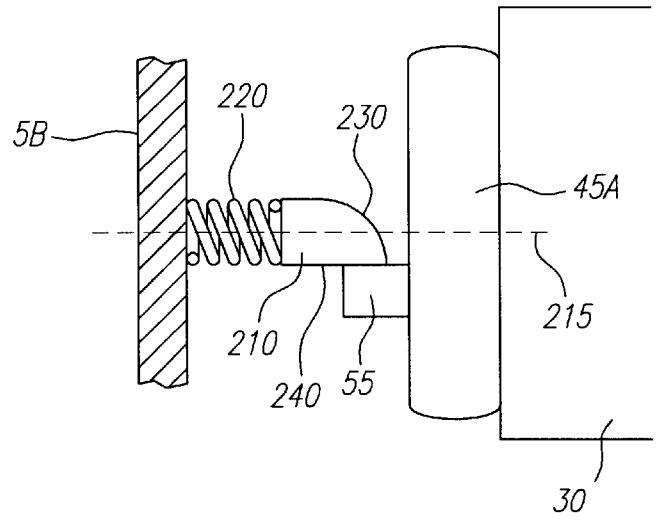

FIGS. 2A–2C show a top view, in which the top 5A of the storage compartment 5 has been cutaway, of a spring-biased tab 210 according to another embodiment of the present invention. In this embodiment, the storage compartment 5 comprises spring-biased tabs 210 slideably connected to opposite sides 5B and 5D of the storage compartment 5 to replace the tabs 20 shown in FIG. 1A. For ease of illustration, FIGS. 2A–2C only show the spring-biased tab 210 on side 5B of the storage compartment 5, although it is to be understood that there is an identical spring-biased tab 210 on side 5D of the storage compartment 5. The spring-biased tabs 210 are each slideably connected to the respective side 5B and 5D of the storage compartment 5 along line 215. Each spring-biased tab 210 is biased by a spring coil 220 that biases the tab 210 in a direction away from the respective side 5B and 5D of the storage compartment 5. In addition, each spring-biased tab 210 has a curved surface 230 facing the backside 5E of the storage compartment 5 and a flat surface 240 facing the front side 5C of the storage compartment 5.

An advantage of the spring-biased tabs 210 according to this embodiment is that they allow the telescoping arms 45A and 45B to be rotated counter-clockwise in going from the storage configuration to the operational configuration without having to raise the flanges 55 above the spring-biased tabs 210. This can be appreciated by referring to FIG. 2B, which shows the flanges 55 contacting the spring-biased tabs 210 in the counterclockwise direction. In this direction, the flanges 55 slide along the curved surfaces 230 of the spring-biased tabs 210. This pushes the spring-biased tabs 210 into the sides 5B and 5D of the storage compartment 5 from their positions in FIG. 2A, which is indicated by the dashed outline. After the flanges 55 are rotated past the spring-biased tabs 210, the spring coils 220 push the spring-biased tabs 210 back out. The flat surfaces 240 of the spring-biased tab 210 can then engage the flanges 55 to hold the telescoping arms 45A and 45B in a predetermined angle as shown in FIG. 2C.

Figure 9:
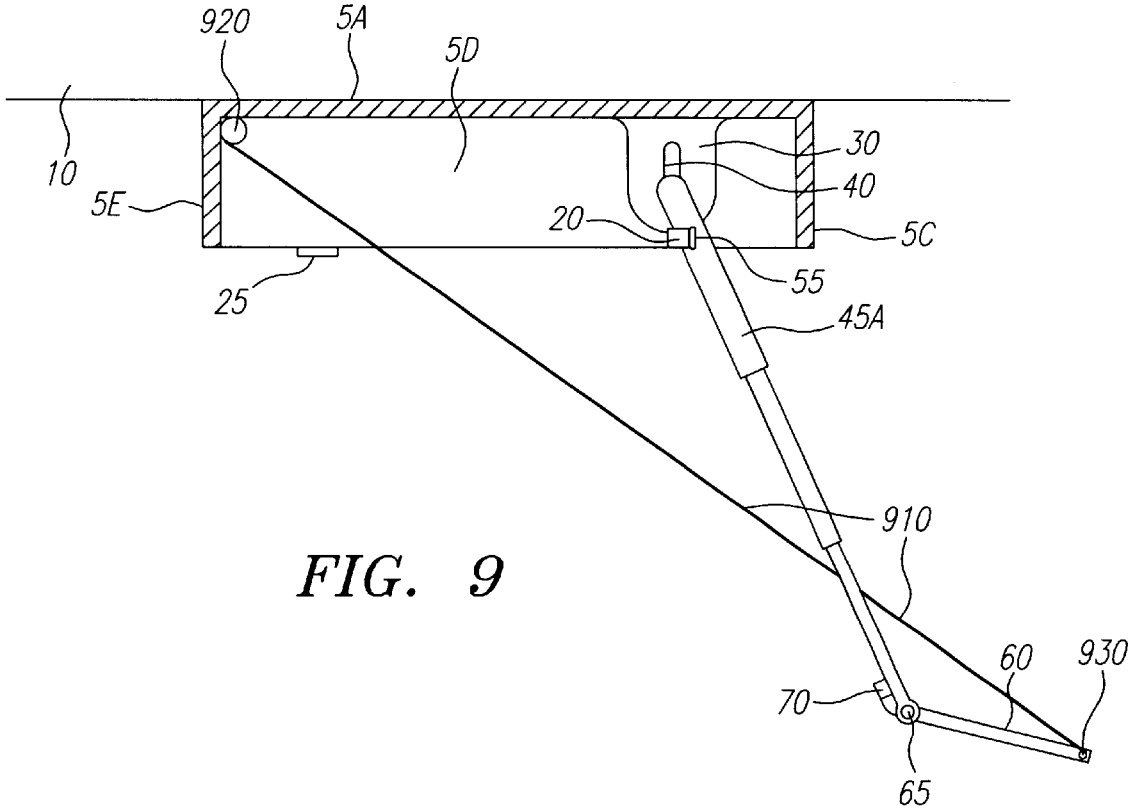
FIG. 9 shows a side view of the keyboard support apparatus, in which side 5B of the storage compartment has been cutaway, according to another embodiment of the invention.

FIG. 9 shows a side view of the keyboard support apparatus 3, in which side 5B of the storage compartment 5 has been cutaway, according to another embodiment of the invention. In this embodiment, the keyboard support apparatus further 3 comprises two retractable spools 920 mounted to opposite sides 5B and 5D of the storage compartment 5. FIG. 9 only shows the retractable spool 920 mounted to side 5B of the storage compartment 5, although it is to be understood that there is an identical spool 920 mounted to side 5D of the storage compartment 5. A suspension wire 910 is wound around each retractable spool 920. One end of each suspension wire 910 is connected to the keyboard platform 60, preferably at an end of the keyboard platform 60 located away from the telescoping arms 45A and 45B. The suspension wires 910 may be connected to the keyboard platform 60 by tightly winding an end of each suspension wire 910 around a screw 930 threaded into the keyboard platform 60. The suspension wires 910 are used to increase the stability of the keyboard platform 60 at the predetermined tilt angle. This is accomplished by adjusting the fully extended length of each suspension wire 910 according to the predetermined tilt angle of the keyboard platform 60. In the storage configuration, the retractable spools 920 pull in the suspension wires 910.

Figure 3:
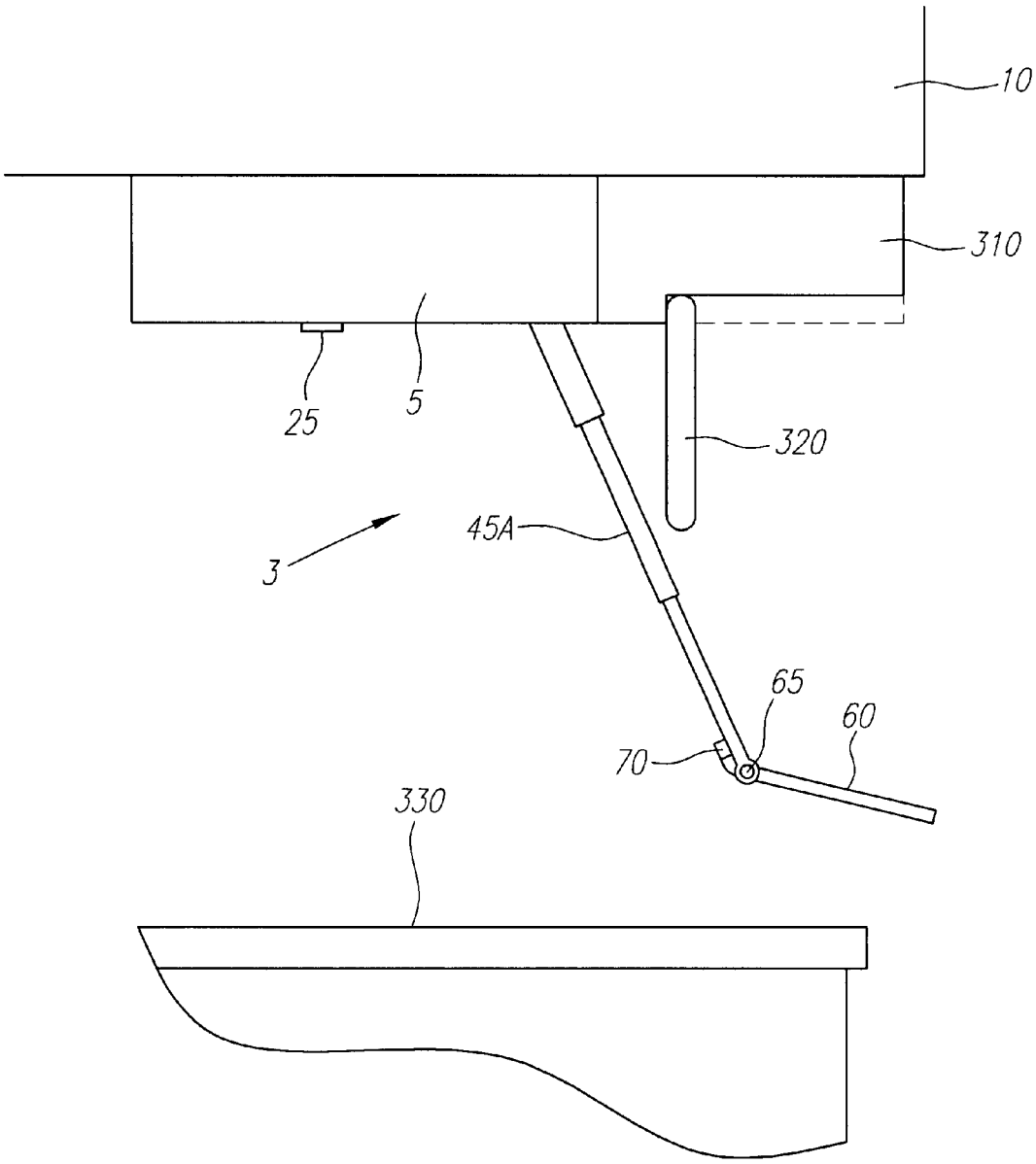
FIG. 3 shows a side view of the keyboard support apparatus adjacent to a computer housing according to one embodiment of the invention.

FIG. 3 shows a side view of the keyboard support apparatus 3 in an exemplary arrangement in which a computer housing 310 is mounted to the undersurface of the overhead cabinet 10 adjacent to the keyboard support apparatus 3. The computer housing 310 may house computer hardware including, but not limited to, a processor, a hard drive, and a modem. In addition, a thin display, such as a Liquid Crystal Display (LCD), is rotatably connected to the computer housing 310. The display 320 may be rotated from a user position, which is shown in FIG. 3, to a storage position, which is indicated by the dashed outline in FIG. 3. Furthermore, a countertop 330 or desktop is located below the overhead cabinet 10.

This arrangement provides a person with a readily accessible computer system that can be compactly stored above the countertop 330 when it is not in use. The computer system includes the computer hardware inside the computer housing 310, the display 320 and a keyboard (not shown) supported on the keyboard platform 60. The keyboard supported on the keyboard platform 60 may be electrically coupled to the computer hardware inside the computer housing 310 via wires or cables. To conceal the wires or cables, one or both of the telescoping arms 45A and 45B may have an internal cavity extending the length of the arm through which the cables or wires may be carried to the keyboard. This may be accomplished, for example, by making the plurality of arms comprising the telescoping arms 45A and 45B hollow.

The keyboard support apparatus 3 according to the present invention offers several advantages. One advantage is that the keyboard platform 60 can support a keyboard above a countertop, which prevents food or drinks that are spilled onto the countertop from damaging the keyboard. This is ideal for use in a kitchen or a bar where food and drinks may be placed on a countertop in close proximity to the keyboard platform 60. Another advantage is that the keyboard support apparatus 3 is able to compactly store a keyboard inside the storage compartment 5 above a countertop. This allows a person to use the countertop space below the storage compartment 5 when the keyboard is not in use.

Those skilled in the art will appreciate that the keyboard support apparatus 3 is not limited to being mounted to an undersurface of an overhead cabinet 10. The keyboard support apparatus 3 may, for example, be mounted to an undersurface of an overhead shelf, an overhead rack, or a low ceiling, where a low ceiling is defined as any ceiling that a person can readily reach by extending his or her arms. The keyboard support apparatus 3 may, for example, be mounted to a low ceiling located directly above a bed, such as a bunk bed. In this example, the keyboard platform 60 may support a keyboard at a height above the bed that enables a person to use the keyboard while he or she is lying in bed. The keyboard may then be compactly stored inside the storage compartment 5 at a height above the bed that provides adequate head clearance for the person to get in and out of the bed.

In addition, a flip-up display may be pivotally attached to one end of the keyboard platform. In this example, the flip-up display may communicate with the keyboard supported on the keyboard platform 60. In addition, the flip-up display may be flipped down over the keyboard supported on the keyboard platform 60 to provide compact storage in the storage configuration.

Figure 4A:
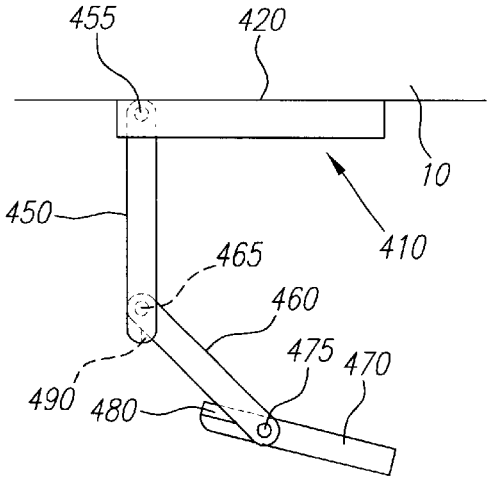
FIGS. 4A and 4B show a side view and a front view, respectively, of the keyboard support apparatus according to another embodiment of the invention.
Figure 4B:
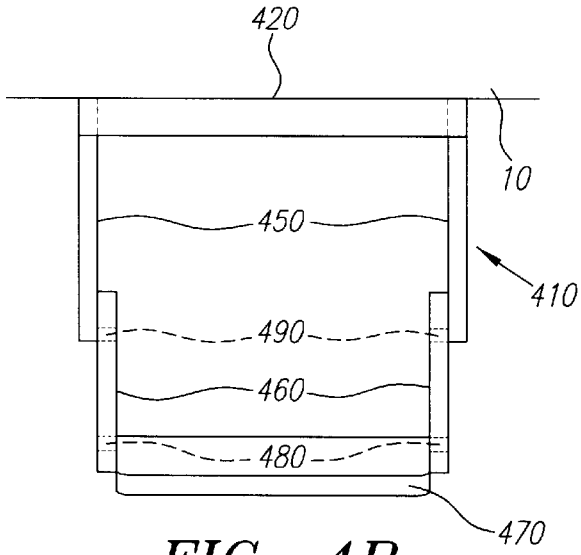

FIGS. 4A and 4B show a side view and a front view, respectively, of a keyboard support apparatus 410 according to another embodiment of the present invention in an operational configuration. The keyboard support apparatus 410 according to this embodiment comprises a storage compartment 420 mounted to an undersurface of an overhead cabinet 10 and having an open bottom. The keyboard support apparatus 410 also comprises two upper arms 450 pivotally connected at one end to opposite sides of the storage compartment 420 by pivot pins 455. The keyboard support apparatus 410 further comprises two lower arms 460 pivotally connected at one end to the other end of the upper arms 450 by pivot pins 465. The lower arms 460 are spaced closer together than the two upper arms 450, as shown in FIG. 4B. The keyboard support apparatus 410 further comprises a keyboard platform 470 pivotally connected at opposite sides to the lower arms 460 by pivot pins 475.

The keyboard platform 470 further comprises two flanges 480 extending outwardly from opposite sides of the keyboard platform 470. The flanges 480 engage a backside of the lower arms 460 to hold the keyboard platform at a predetermined angle with respect to the lower arms 460. Each upper arm 450 further comprises an arm flange 490 extending inwardly from the side of the upper arm 450 facing the other upper arm 450. Each arm flange 490 engages a backside of one of the lower arms 460 to hold the lower arm 460 at a predetermined angle with respect to the upper arm 450.

Figure 13A:
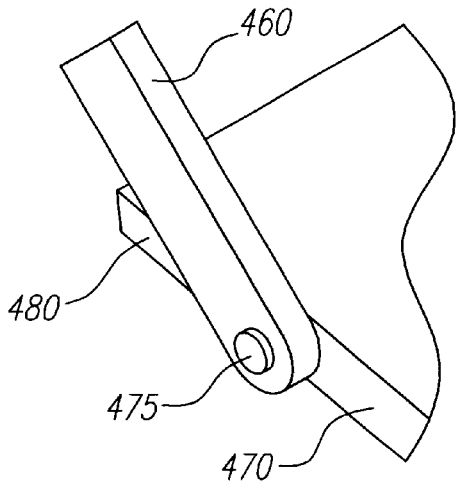
FIG. 13A shows an exploded perspective view of the flange on the keyboard platform according to another embodiment of the invention.
Figure 13B:
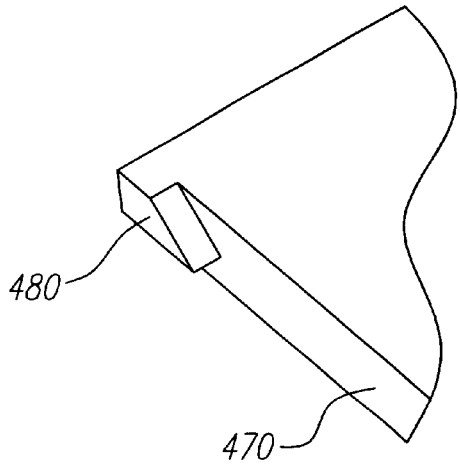
FIG. 13B shows the same view as FIG. 13A in which the lower arm in FIG. 13A has been removed.

FIG. 13A shows an exploded perspective view of one of the flanges 480 on the keyboard platform 470. FIG. 13B shows the same view as FIG. 13A in which the telescoping arm 460 has been removed. The flange 480 extends or protrudes out from a side of the keyboard platform 470. The flange 480 holds the keyboard platform at the tilt angle by pushing against the backside of the lower arm 460.

Figure 4C:
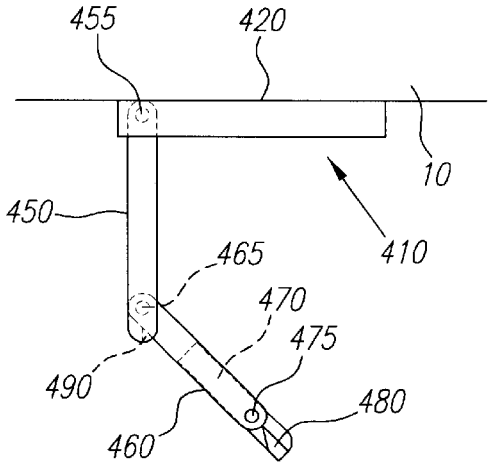
FIGS. 4C–4E show a side view of the keyboard support apparatus, in which a side of the storage compartment has been cutaway, in going from the operational configuration to a storage configuration according to the embodiment shown in FIGS. 4A and 4B.
Figure 4D:
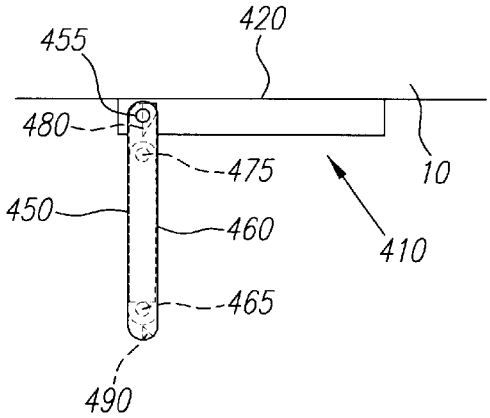
Figure 4E:
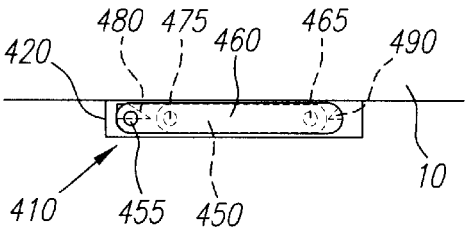
Figure 13C:
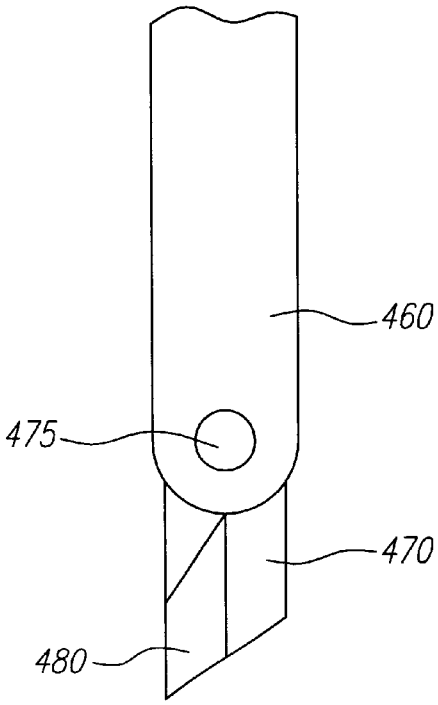
FIG. 13C shows an exploded view of the keyboard platform rotated to aligned it with the lower arm according to the embodiment shown in FIG. 13A.

FIGS. 4C–4E show a side view of the keyboard support apparatus 410, in which a side of the storage compartment 420 has been cutaway, in going from the operational configuration to a storage configuration. In FIG. 4C, the keyboard platform 470 is rotated counter-clockwise to align it with the lower arms 460. FIG. 13C shows an exploded view of the keyboard platform 470 when it is aligned with the lower arm 460. In FIG. 4D, the lower arms 460 and the keyboard platform 470 are rotated together counter-clockwise to align them with the upper arms 450. In FIG. 4E, the upper arms 450, the lower arms 460, and the keyboard platform 470 are rotated together counterclockwise to a position inside the storage compartment 420.

Figure 5:
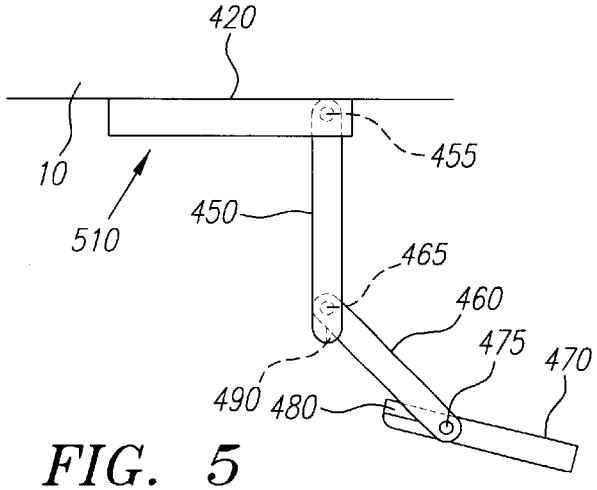
FIG. 5 shows a side view of a keyboard support apparatus that is a variation of the keyboard support apparatus according to the embodiment shown in FIGS. 4A and 4B.

FIG. 5 shows a variation of the keyboard support apparatus 510 of this embodiment in which the upper arms 450 are pivotally connected to the storage compartment 420 at another end of the storage compartment 420. In this case, the keyboard support apparatus 510 is configured from the operational configuration to the storage configuration following similar steps to the ones shown in FIGS. 4C and 4D. In the last step, however, the upper arms 450, the lower arms 460, and the keyboard platform 470 are rotated together clockwise, rather than counter-clockwise, to a position inside the storage compartment 420.

Figure 6A:
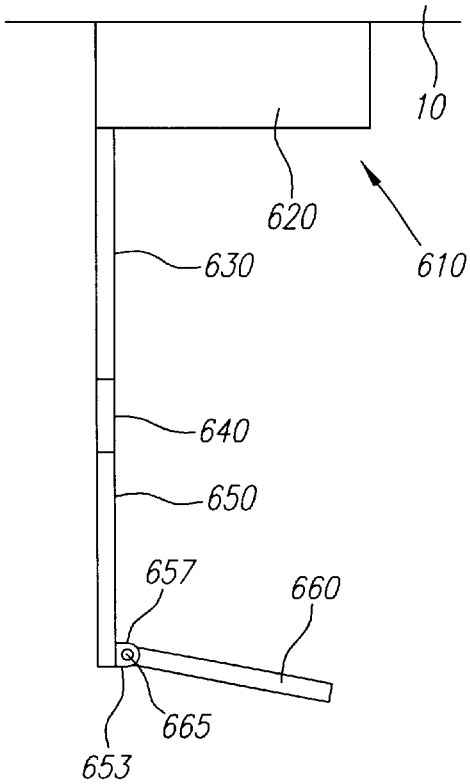
FIGS. 6A and 6B show a side view and a front view, respectively, of the keyboard support apparatus according to yet another embodiment of the present invention.
Figure 6C:
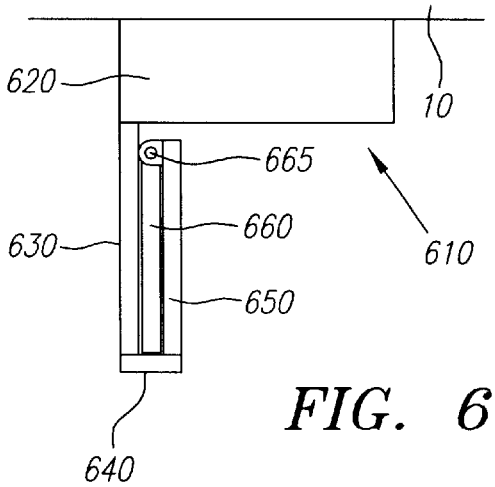
FIGS. 6C and 6D show a side view of the keyboard support apparatus, in which a side of the storage compartment has been cutaway, in going from the operational configuration to a storage configuration according to the embodiment shown in FIGS. 6A and 6B.
Figure 6B:
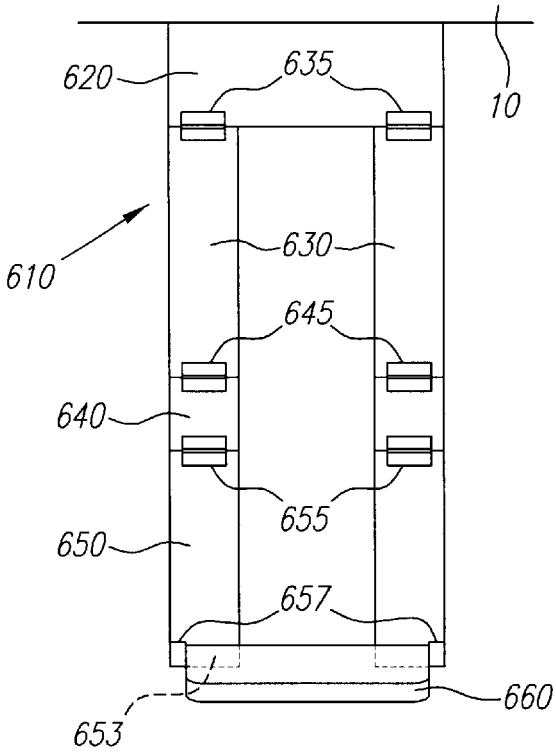

FIGS. 6A and 6B show a side view and a front view, respectively, of a keyboard support apparatus 610 according to yet another embodiment of the present invention in an operational configuration. The keyboard support apparatus 610 according to this embodiment comprises a storage compartment 620 mounted to the undersurface of the overhead cabinet 10 and having an open bottom. The keyboard support apparatus 610 also comprises upper arms 630 pivotally connected to a backside of the storage compartment 620 by hinges 635, and two middle arms 640 pivotally connected to the upper arms 630 by hinges 645. The keyboard support apparatus 610 further comprises two bottom arms 650 pivotally connected to the middle arms 640 by hinges 655 and each bottom arm 650 having a perpendicular protrusion 657. The keyboard support apparatus 610 also comprises a keyboard platform 660 pivotally connected at opposite sides to the perpendicular protrusions 657 of the bottom arms 650 by pivot pins 665. A backside of the keyboard platform rest 660 against surfaces 653 of the bottom arms 650 to hold the keyboard platform at a predetermined angle.

Figure 6D:
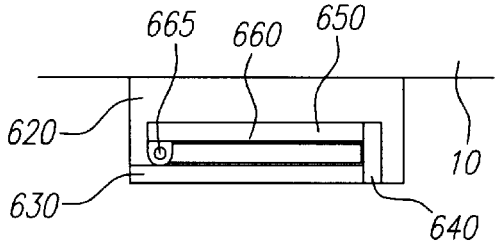

FIGS. 6C and 6D show a side view of the keyboard support apparatus 610, in which a side of the storage compartment 620 has been cutaway, in going from the operational configuration to a storage configuration. In FIG. 6C, the keyboard platform 660 is rotated counter-clockwise to a position parallel to the bottom arms 650, and the bottom arms 650 are rotated counter-clockwise to a position parallel to the upper arms 630. This places the bottom arms 650 and upper arms 630 in a position perpendicular to the middle arms 640. In FIG. 6D, the upper arms 630 are rotated counter-clockwise to a position inside the storage compartment 620.

In this embodiment, a flat display (not shown), such as a Liquid Crystal Display (LCD), may be mounted between the upper arms 630 or the bottom arms 650. Preferably, the flat display has a thickness equal to or smaller than the arms between which it is mounted. That way, the flat display may be mounted between the upper arms 630 or the bottom arms 650 in such a way that it does not interfere with the movements of the keyboard support apparatus 610.

Figure 7B:
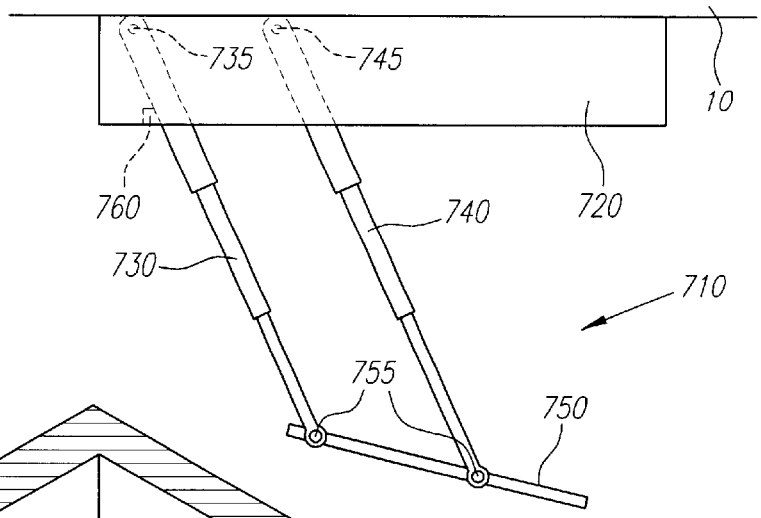
FIGS. 7A and 7B show a side view and a front view, respectively, of the keyboard support apparatus according to still another embodiment of the invention.
Figure 7A:
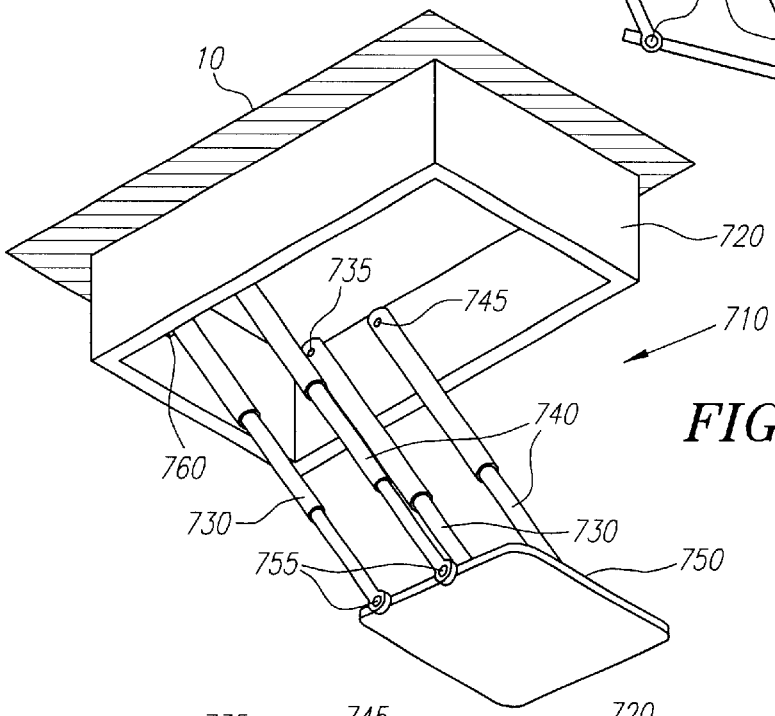

FIGS. 7A and 7B show a perspective view and a side view, respectively, of a keyboard support apparatus 710 according to still another embodiment of the present invention in an operational configuration. The keyboard support apparatus 710 according to this embodiment comprises a storage compartment 720 mounted to the undersurface of the overhead cabinet 10 and having an open bottom. The keyboard support apparatus 710 also comprises two back telescoping arms 730 pivotally connected to opposite sides of the storage compartment 720 by pivot pins 735, and two front telescoping arms 740 pivotally connected to opposite sides of the storage compartment 720 by pivot pins 745. The keyboard support apparatus 710 further comprises a keyboard platform 750 pivotally connected to the back telescoping arms 730 and the front telescoping arms 740 by pivot pins 755. The front telescoping arms 740 extend to a slightly longer length than the back telescoping arms 730 so that the keyboard platform 750 is tilted at a predetermined angle.

The keyboard support apparatus 710 further comprises tabs 760 attached to opposite sides of the storage compartment 720 and extending inwardly. The tabs 760 engage a backside of the back telescoping arms 730 to prevent the arms 730 from rotating clockwise beyond a predetermined angle.

Figure 7C:
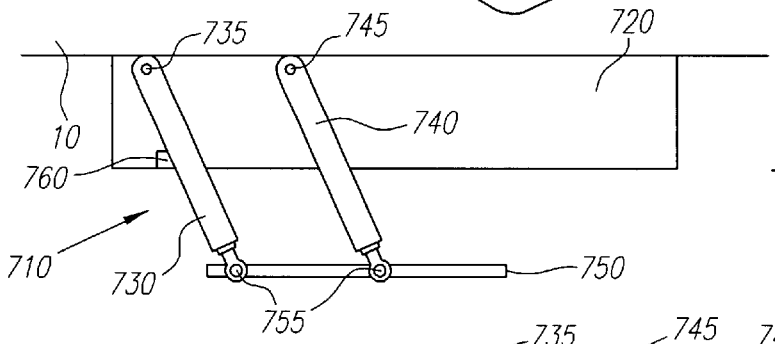
FIGS. 7C and 7D show a side view of the keyboard support apparatus, in which a side of the storage compartment has been cutaway, in going from the operational configuration to a storage configuration according to the embodiment shown in FIGS. 7A and 7B.
Figure 7D:
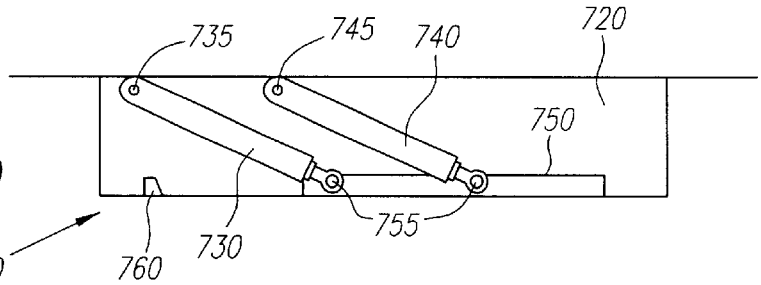

FIGS. 7C and 7D show a side view of the keyboard support apparatus 710, in which a side of the storage compartment 720 has been cutaway, in going from the operational configuration to a storage configuration. In FIG. 7C, the keyboard platform 760 is pushed up such the back telescoping arms 730 and the front telescoping arms 740 are contracted to their minimal length. In FIG. 7D, the back telescoping arms 730 and the front telescoping arms 740 are rotated counter-clockwise so that the keyboard platform 760 is positioned inside the storage compartment 720.

Figure 8A:
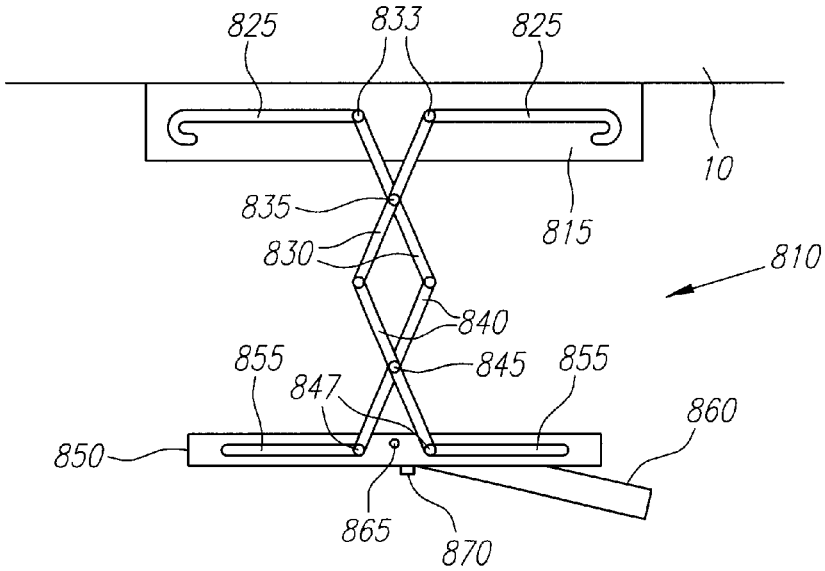
FIGS. 8A and 8B show a side view and a front view, respectively, of the keyboard support apparatus according to still another embodiment of the invention.
Figure 8B:
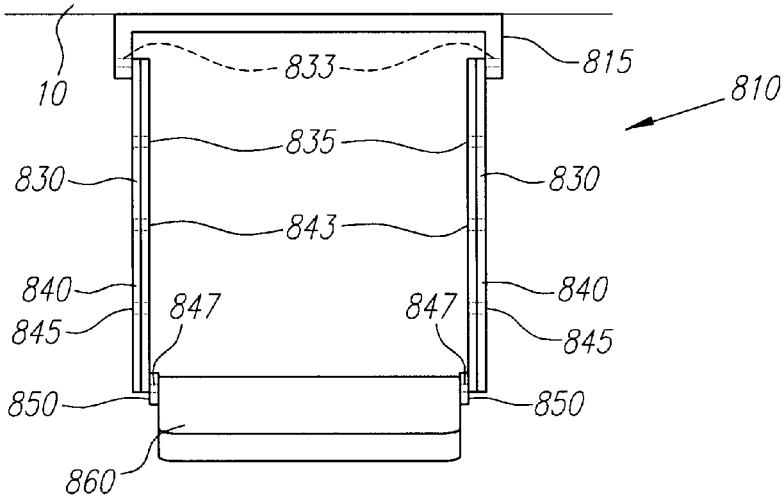

FIGS. 8A and 8B show a side and a front view, respectively, of a keyboard support apparatus 810 according to still a further embodiment of the present invention. The keyboard support apparatus 810 comprises a bracket 815 having two bent sides. Each bent side has two slots 825, each slot 825 having a curved-in end. The keyboard support apparatus 810 also comprises two pairs of top levers 830. The levers in each pair of top levers 830 are pivotally connected to each other at their mid-point by a pivot pin 835. In addition, one end of each top lever 830 is pivotally and slideably connected to the bracket 815 by a pin 833 inserted into each of the slots 825. The keyboard support apparatus 810 further comprises two pairs of bottom levers 840. The levers in each pair of bottom levers 840 are pivotally connected to each other at their mid-point by a pivot pin 845. In addition, each bottom lever 840 is pivotally connected at one end to one of the top levers 830 by a pivot pin 843.

The keyboard support apparatus 810 further comprises two bottom rails 850, each rail 850 having two slots 855. One end of each bottom lever 840 is pivotally and slideably connected to one of the bottom rails 850 by a pin 847 inserted into each of the slots 855 in the bottom rails 850. The keyboard support apparatus 810 further comprises a keyboard platform 860 pivotally connected at opposite sides to the bottom rails 850 by pivot pins 865. Each bottom rail 850 comprises a flange 870 extending inwardly from the side of the bottom rail 850 facing the other bottom rail 850 and engaging a bottom of the keyboard platform 860 to hold the keyboard platform 860 at a predetermined tilt angle.

Figure 8C:
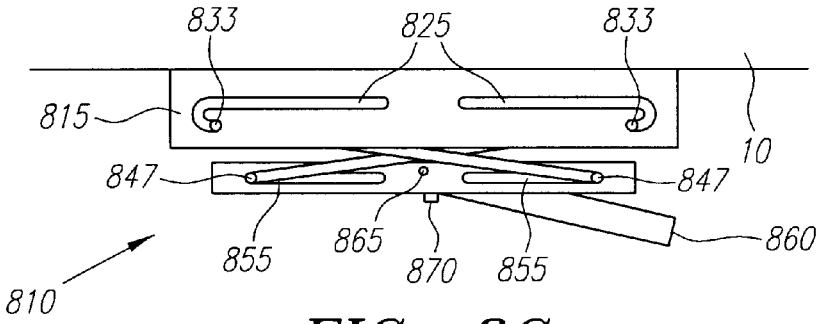
FIG. 8C shows a side view of the keyboard support apparatus, in which a side of the storage compartment has been cutaway, in going from the operational configuration to a storage configuration according to the embodiment shown in FIGS. 8A and 8B.

FIG. 8C shows the keyboard support apparatus in a storage configuration. The keyboard platform is pushed up into a storage compartment (not shown) enclosing the bracket 815. The pins 833 connecting the lop levers 833 to the bracket 815 are slid along the slots 825 of the bracket 815 to the curved-in ends of the slots 825. The curved-in ends of the slots 825 hold the pins 833 in place, and thereby the keyboard platform 860, in the storage configuration. The pins 847 connecting the bottom levers 840 to each bottom rail 850 are slid to opposite ends of the slots 855.

Those skilled in the art will appreciate that various modification may be made to the just described preferred embodiments without departing from the spirit and scope of the invention. Therefore, the invention is not to be restricted or limited except in accordance with the following claims and their legal equivalents.

What is claimed is:

1. A keyboard support apparatus, comprising:

a storage compartment having at least one side and an open bottom;

at least one extendable support arm, each support arm being pivotally coupled at one end to the storage compartment; and a keyboard platform, the keyboard platform being pivotally coupled to the other end of each support arm, wherein the keyboard platform further comprises one or more flanges, each flange extending outwardly from a side of the keyboard platform and each flange being adapted to engage a backside of the at least one support arm to hold the keyboard platform at a predetermined tilt angle.

2. The keyboard support apparatus of claim 1, wherein the storage compartment further comprises a top.

3. The keyboard support apparatus of claim 1, wherein each support arm is extendable to a position at which the keyboard platform is below the bottom of the storage compartment.

4. The keyboard support apparatus of claim 3, wherein each telescoping support arm is extendable to a position at which the keyboard platform is at least one foot below the bottom of the storage compartment.

5. The keyboard support apparatus of claim 1, wherein each support arm is extendable to a position at which the keyboard platform is at least two feet below the bottom of the storage compartment.

6. The keyboard support apparatus of claim 1, wherein the storage compartment is capable of fitting the at least one support arm and the keyboard platform inside the storage compartment.

7. The keyboard support apparatus of claim 1, wherein each support arm is a telescoping arm.

8. The keyboard support apparatus of claim 1, wherein the storage compartment further comprises at least one tab, each tab extending inwardly from one of the at least one sides of the storage compartment.

9. The keyboard support apparatus of claim 8, wherein at least one support arm further comprises a flange, the flange extending outwardly from a side of the support arm and the flange being adapted to engage a corresponding one of the at least one tab on the storage compartment to hold the support arm at a predetermined angle.

10. The keyboard support apparatus of claim 9, wherein each support arm is slideably coupled to the storage compartment.

11. The keyboard support apparatus of claim 10, wherein each support arm having the flange is slideable to a position in which the flange on the support arm engages the corresponding one of the at least one tab on the storage compartment and is slideable to a position in which the flange on the support arm disengages the corresponding one of the at least one tab on the storage compartment.

12. The keyboard support apparatus of claim 1, further comprising at least one retractable spool mounted to the storage compartment, each retractable spool having a suspension wire connected at one end to the keyboard platform.

13. The keyboard support apparatus of claim 1, further comprising at least one latch, each latch pivotally coupled to one of the at least one side of the storage compartment and each latch capable of supporting the keyboard platform inside the storage compartment.

14. A keyboard support apparatus, comprising:

a storage compartment having at least one side and an open bottom;

at least one extendable support arm, each support arm being pivotally coupled at one end to the storage compartment;

a keyboard platform, the keyboard platform being pivotally coupled to the other end of each support arm; and at least one latch, each latch pivotally coupled to one of the at least one side of the storage compartment and each latch capable of supporting the keyboard platform inside the storage compartment.

15. The keyboard support apparatus of claim 14, wherein the storage compartment further comprises a top.

16. The keyboard support apparatus of claim 14, wherein each support arm is extendable to a position at which the keyboard platform is below the bottom of the storage compartment.

17. The keyboard support apparatus of claim 16, wherein each telescoping support arm is extendable to a position at which the keyboard platform is at least one foot below the bottom of the storage compartment.

18. The keyboard support apparatus of claim 17, wherein each support arm is extendable to a position at which the keyboard platform is at least two feet below the bottom of the storage compartment.

19. The keyboard support apparatus of claim 14, wherein the storage compartment is capable of fitting the at least one support arm and the keyboard platform inside the storage compartment.

20. The keyboard support apparatus of claim 19, wherein the keyboard platform further comprises one or more flanges, each flange extending outwardly from a side of the keyboard platform and each flange being adapted to engage a backside of the at least one support arm to hold the keyboard platform at a predetermined tilt angle.

21. The keyboard support apparatus of claim 14, wherein the storage compartment further comprises at least one tab, each tab extending inwardly from one of the at least one sides of the storage compartment.

22. The keyboard support apparatus of claim 21, wherein at least one support arm further comprises a flange, the flange extending outwardly from a side of the support arm and the flange being adapted to engage a corresponding one of the at least one tab on the storage compartment to hold the support arm at a predetermined angle.

23. The keyboard support apparatus of claim 22, wherein each support arm is slideably coupled to the storage compartment.

24. The keyboard support apparatus of claim 23, wherein each support arm having the flange is slideable to a position in which the flange on the support arm engages the corresponding one of the at least one tab on the storage compartment and is slideable to a position in which the flange on the support arm disengages the corresponding one of the at least one tab on the storage compartment.

25. The keyboard support apparatus of claim 14, further comprising at least one retractable spool mounted to the storage compartment, each retractable spool having a suspension wire connected at one end to the keyboard platform.

26. The keyboard support apparatus of claim 14, wherein each support arm is a telescoping arm.

* * * * *